United States Patent [19]

Wilde et al.

[11] 4,063,702

[45] Dec. 20, 1977

[54] CORNER PROTECTORS

[76] Inventors: Melvyn Wilde, 21 Lime Grove, Lowton, Warrington, Cheshire; Robert John Sutton, 50 Westbourne Road, Birkdale, Southport, Lancashire, both of England

[21] Appl. No.: 740,238

[22] Filed: Nov. 9, 1976

[51] Int. Cl.[2] ..... A47B 95/00

[52] U.S. Cl. ..... 248/345.1; 206/453; 229/DIG. 1; 52/288

[58] Field of Search ..... 52/624, 657, 288; 206/453; 217/65; 229/DIG. 1; 190/37; 248/345.1

[56] References Cited

U.S. PATENT DOCUMENTS

| | | | |
|---|---|---|---|
| 3,047,142 | 7/1962 | Heffley | 206/453 |
| 3,049,260 | 8/1962 | Stone | 229/DIG. 1 |
| 3,144,236 | 8/1964 | Clanin | 248/345.1 |

*Primary Examiner*—James L. Ridgill, Jr.
*Attorney, Agent, or Firm*—Larson, Taylor and Hinds

[57] ABSTRACT

A corner protector, such as for protecting the corners of plate or board-like articles, is made as a single moulding of plastics material and comprises top and bottom triangular planar parts, to slide over respective top and bottom parallel faces of the board, and wall parts; edges of all said parts defining a mouth to allow the protector to be applied to a corner of the board, the wall parts including resilient means to allow the top and bottom planar parts to move apart elastically. The resilient means may comprise springs of folded strand form lying in the plane of the wall parts. Preferably, the corner edge of the protector which abuts the corner edge of the board is thickened and rounded by a protuberance of cylindrical form.

4 Claims, 2 Drawing Figures

CORNER PROTECTORS

BACKGROUND OF THE INVENTION

The present invention relates to protectors for the corners of articles having, at their corners, a pair of substantially plane parallel faces and edge faces such as veneered or laminate covered boards, glass plate and mirrors, picture frames, books, constructional partitions, and highly finished metal plate articles such as dies for plastics extrusion.

Corner protectors are known, of hollow triangular prismatic form, which can fit over the corners of boards, furniture tops etc. to prevent damage during storage, stacking, handling and transport. Such protectors may be made of paperboard but are frequently made of plastics material. Whichever material is used a large stock of protectors has to be retained to fit the various thickness of material to be protected having in mind that board thickness can be governed by so many differing standards and requirements and having in mind that an incorrectly sized protector is either difficult to fit or strained (because of tightness) or easily dislodged (because of looseness). In fact, careless selection of a correct size of protector could, with time, have the same effect as not providing a protector at all. Further, the making of dies of various sizes to allow manufacture of protectors of various sizes is very costly.

SUMMARY OF THE INVENTION

It is an object of the invention to provide a corner protector which has, within a useful range of dimensions, a universal application so that, for that range, only one protector is required. The benefits that arise from the invention are that overall manufacture costs are reduced, stocking can be reduced and the risk of assembly mistakes is reduced.

In accordance with the present invention a corner protector made from a single plastics moulding is characterised in that the wall parts of the protector include resilient means to allow the top and bottom planar parts to move apart elastically at spring means in the wall parts. An easily and inexpensively formed spring means comprises a plurality of springs each in the form of a folded strand lying in the planes of the wall parts of the protector adjacent to the mouth of the protector, the springs being moulded integrally with the remainder of the protector. The moulding will include easily fractured moulding fillets which temporarily hold the wall parts at a fixed dimension and which are broken in use so that opposed upper and lower similar component halves of the protector can move relatively to each other restrained only by the springs.

BRIEF DESCRIPTION OF THE DRAWINGS

A protector according to the present invention will now be described by way of example only with reference to the accompanying drawing in which.

DESCRIPTION OF THE PREFERRED EMBODIMENT

Figure 1:
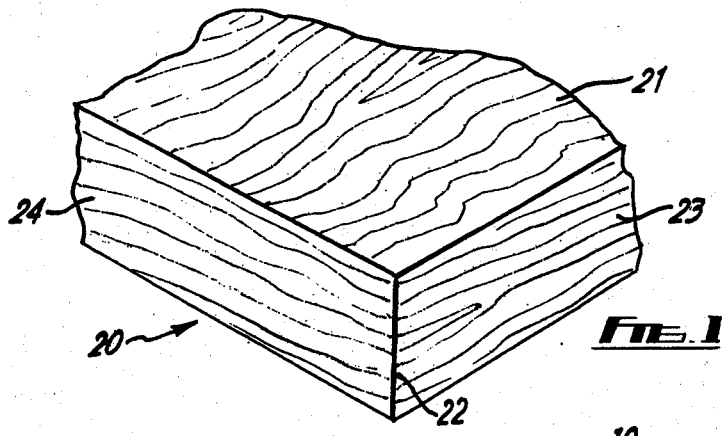
FIG. 1 is a perspective view of the corner region of a veneered board and FIG. 2 is a perspective view of the protector.
Figure 2:
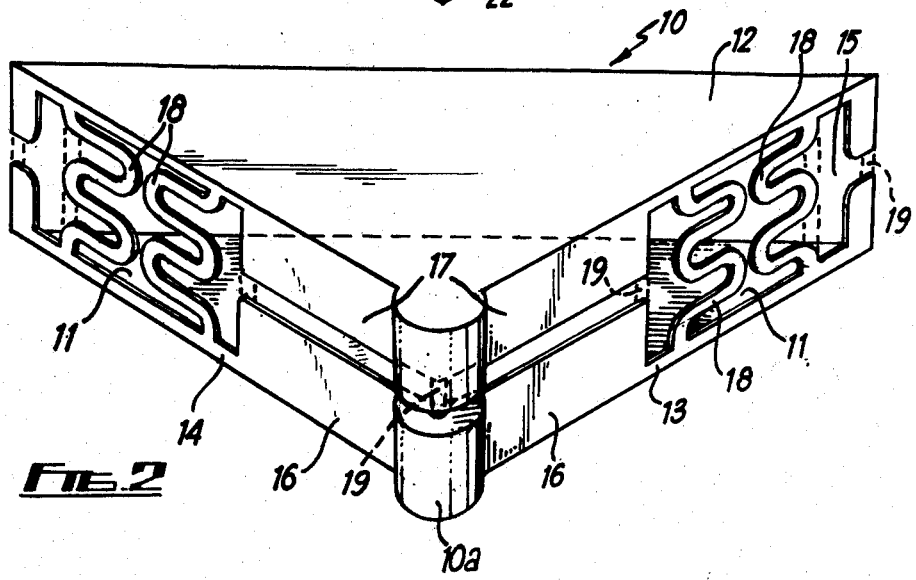

The drawing shows a protector 10 according to the invention and the corner region 20 of a veneered board which is to be protected by the protector. The board has a pair of plane parallel top and bottom faces (only the top face 21 being seen) and edge faces 23, 24 joining at a corner edge 22.

The protector has triangular shaped floor and ceiling planar parts 11, 12, to slide over respective parallel faces of the corner region 20 of the veneered board and has wall parts 13, 14 extending between the parts 11, 12 to contact the respective edge faces 23, 24 of the corner region 20. Edges of the parts 11, 12, 13 and 14 define a mouth 15 to allow the protector to be applied to the corner region 20.

Each wall part is defined by three principal parts, namely a flange 16 on the floor part 11, a flange 17 on the ceiling part 12 where the wall parts 13, 14 are adjacent to each other and springs 18 extending between floor and ceiling parts where the wall members are remote from each other so that the springs are adjacent to the mouth 15. The springs are of folded strand and lie substantially in the plane of the wall parts.

The protector is made as a single moulding of polyethylene and has easily breakable fillets 19 which are shown by dash lines. These fillets are broken in use so that the protector has opposed upper and lower similar component halves movable relative to each other and restrained only by the springs 18.

The protector described above may typically be used with corners ranging in thickness from a base thickness, that is the thickness of the protector as moulded, to a thickness 50% larger than the base thickness.

To give added protection to corner edge 22 of corner region 20, to act as a corner spacer, and to eliminate a sharp edge to the protector 10, the protector has a cylindrical form protuberance **10*a***.

The protector 10 is fitted to the corner region 20 by expanding the springs 18 and sliding the protector over the corner region.

We claim:

1. In a corner protector, for the corner of an article having upper and lower parallel faces and adjacent edge faces, comprising floor and ceiling planar parts to slide over respective ones of said parallel faces and wall parts extending between the floor and ceiling parts to contact respective ones of said edge faces, the improvement in that the wall parts are defined by flanges on the ceiling part, and flanges on the floor part spaced apart from said flanges on the ceiling part, and including spring means at said flanges and between the ceiling and floor parts to allow the floor and ceiling parts and their flanges to move apart elastically.

2. A protector as claimed in claim 1 in which breakable fillets are provided between the flanges on the ceiling part and the flanges on the floor part whereby the wall parts are held temporarily at a fixed dimension.

3. A corner protector comprising a triangular-shaped ceiling part, a triangular-shaped floor part and side wall parts and edges of said parts defining a mouth for the protector, in which said protector is formed as a single moulding of plastics material, the moulding comprising two similar opposed spaced components one forming said ceiling part and one half of each of said wall parts and the other forming said floor part and the other half of each of said wall parts and springs of folded strand form extending between said components, adjacent to the mouth of the protector, lying in the plane of the wall parts and integral with said two components.

4. A corner protector comprising a ceiling part, a floor part and side wall parts and edges of said parts defining a mouth for the protector, in which said protector is formed as a single molding of plastics material, the molding comprising two opposed spaced components, one forming said ceiling part and one fraction of each of said wall parts, and the other forming said floor part and the remaining fraction of each of said wall parts, and springs of folded strand form extending between said components, lying in the plane of the wall parts, and integral with said two components.

* * * * *